US009017103B2

(12) United States Patent
Davis et al.

(10) Patent No.: US 9,017,103 B2
(45) Date of Patent: Apr. 28, 2015

(54) MODULAR CONNECTOR ASSEMBLY

(71) Applicant: Tyco Electronics Corporation, Berwyn, PA (US)

(72) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 108 days.

(21) Appl. No.: 13/948,851

(22) Filed: Jul. 23, 2013

(65) Prior Publication Data

US 2015/0031238 A1 Jan. 29, 2015

(51) Int. Cl.
*H01R 13/648* (2006.01)
*H01R 12/50* (2011.01)

(52) U.S. Cl.
CPC ..... *H01R 23/688* (2013.01)

(58) Field of Classification Search
USPC ..... 439/607.1, 607.05, 7.35, 607.34, 439/607.35, 607.36, 607.01, 607.27, 638, 439/648, 660
See application file for complete search history.

(56) References Cited

U.S. PATENT DOCUMENTS

| | | | | |
|---|---|---|---|---|
| 5,525,066 | A * | 6/1996 | Morlion et al. | 439/108 |
| 2012/0252271 | A1* | 10/2012 | Pan | 439/607.01 |
| 2013/0210246 | A1* | 8/2013 | Davis et al. | 439/65 |
| 2014/0017950 | A1 | 1/2014 | Peloza | |

* cited by examiner

*Primary Examiner* — Abdullah Riyami
*Assistant Examiner* — Harshad Patel

(57) ABSTRACT

A modular connector assembly includes a housing having a mating end and a mounting end opposite the mating end. The mating end is configured to be mated with a header connector and the mounting end is configured to be mounted to a circuit board. The housing has a plurality of individual chambers separated by chamber walls. Contact assemblies are received in corresponding chambers. Each contact assembly has a dielectric body holding a differential pair of receptacle signal contacts configured to be terminated to the circuit board and mated with corresponding header signal contacts of the header connector. Each contact assembly has a ground shield coupled to an exterior of the dielectric body providing electrical shielding for the differential pair of receptacle signal contacts from other pairs of receptacle signal contacts.

20 Claims, 6 Drawing Sheets

MODULAR CONNECTOR ASSEMBLY

BACKGROUND OF THE INVENTION

The subject matter herein relates generally to a modular connector assembly for interconnecting two circuit boards.

Some electrical connector systems utilize receptacle and header connectors to interconnect two circuit boards, such as a motherboard and daughtercard. The circuit boards are typically arranged perpendicular to one another. The receptacle connector has right angle chicklets or wafers that transition between the corresponding circuit board and the header connector. The wafers typically hold a plurality of signal conductors that transition through a right angle transition. At least one known problem with receptacle connectors that use such wafers is that the cost to manufacture similar receptacle connectors having different designs is very high. For example, when different designs are needed, such as receptacle connectors that have a different number of signal conductors or a different spacing between the signal conductors, a new mold and tooling setup needs to be designed and manufactured. Such setup costs are very expensive.

A need remains for a connector that can be produced in different size configurations at relatively low cost.

BRIEF DESCRIPTION OF THE INVENTION

In one embodiment, a modular connector assembly is provided that includes a housing having a mating end and a mounting end opposite the mating end. The mating end is configured to be mated with a header connector and the mounting end is configured to be mounted to a circuit board. The housing has a plurality of individual chambers separated by chamber walls. Contact assemblies are received in corresponding chambers. Each contact assembly has a dielectric body holding a differential pair of receptacle signal contacts configured to be terminated to the circuit board and mated with corresponding header signal contacts of the header connector. Each contact assembly has a ground shield coupled to an exterior of the dielectric body providing electrical shielding for the differential pair of receptacle signal contacts from other pairs of receptacle signal contacts.

Optionally, the ground shield may be C-shaped and surround the differential pair of receptacle signal contacts on three sides thereof. The ground shield may cooperate with adjacent ground shields to provide electrical shielding of each differential pair of receptacle signal contacts from each other differential pair of receptacle signal contacts.

Optionally, the dielectric body may be overmolded around the corresponding differential pair of receptacle signal contacts. The overmolded dielectric body and differential pair of receptacle signal contacts may be loaded into the corresponding chamber and separated from other contact assemblies by the chamber walls.

Optionally, the receptacle signal contacts may extend along contact axes through the dielectric body that are perpendicular to the circuit board. The receptacle signal contacts may extend along contact axes through the dielectric body that are perpendicular to the mating end and the mounting end.

Optionally, the receptacle signal contacts may include tails extending from the mating end that are terminated to the circuit board. The receptacle signal contacts may include mating ends extended from a top of the dielectric body that define a socket configured to be mated with corresponding header signal contacts of the header connector. The ground shield may include grounding beams extending from a top of the ground shield. The grounding beams may extend along the mating ends of the receptacle signal contacts. The grounding beams may be coupled to the corresponding header ground shield of the header connector.

Optionally, the ground shield may include retention barbs engaging the chamber walls to hold the contact assemblies in the corresponding chambers. The ground shield may include a stop tab at a bottom of the ground shield. The contact assembly may be loaded into the chamber until the stop tab engages the housing. The ground shield may include locating features engaging the chamber walls for locating the contact assembly within the chambers.

Optionally, the dielectric body may include legs at the bottom of the dielectric body engaging the housing to locate the contact assembly within the chamber. The dielectric body may include retention slots along sides thereof. The ground shield may include retention tabs extending therefrom received in the retention slots to secure the ground shield to the dielectric body.

Optionally, a bottom of the ground shield may extend downward beyond a bottom of the dielectric body defining a pocket at the bottom of the dielectric body. The ground shield may have ground tails extending from the bottom of the ground shield and the receptacle signal contacts may have contact tails extending downward from the bottom of the dielectric body. The ground tails and contact tails may be terminated to the circuit board. The modular connector assembly may include an organizer coupled to the mounting end of the housing having a plurality of channels therethrough receiving corresponding ground tails and contact tails to position the ground tails and contact tails relative to one another. The organizer may have pads substantially filling each pocket.

In another embodiment, a modular connector assembly is provided that includes a header connector having a header housing having a base wall and shroud walls extending from the base wall and defining a cavity. The base wall is configured to be mounted to a header circuit board. The header housing holds a plurality of header signal contacts in the cavity arranged in pairs. The header housing holds a plurality of header ground shields in the cavity with each header ground shield at least partially surrounding a corresponding pair of header signal contacts. The modular connector assembly further includes a receptacle connector received in the cavity and coupled to the header connector. The receptacle connector includes a receptacle housing having a mating end and a mounting end opposite the mating end. The mating end is configured to be mated with the header connector and the mounting end is configured to be mounted to a receptacle circuit board. The receptacle housing has a plurality of individual chambers separated by chamber walls. The receptacle connector has contact assemblies received in corresponding chambers. Each contact assembly has a dielectric body holding a differential pair of receptacle signal contacts. The receptacle signal contacts are configured to be terminated to the receptacle circuit board and configured to be mated with corresponding header signal contacts of the header connector. Each contact assembly has a receptacle ground shield coupled to an exterior of the dielectric body. The receptacle ground shield provides electrical shielding for the differential pair of receptacle signal contacts from other pairs of receptacle signal contacts. Each receptacle ground shield is mated with a corresponding header ground shield.

DETAILED DESCRIPTION OF THE INVENTION

Figure 1:
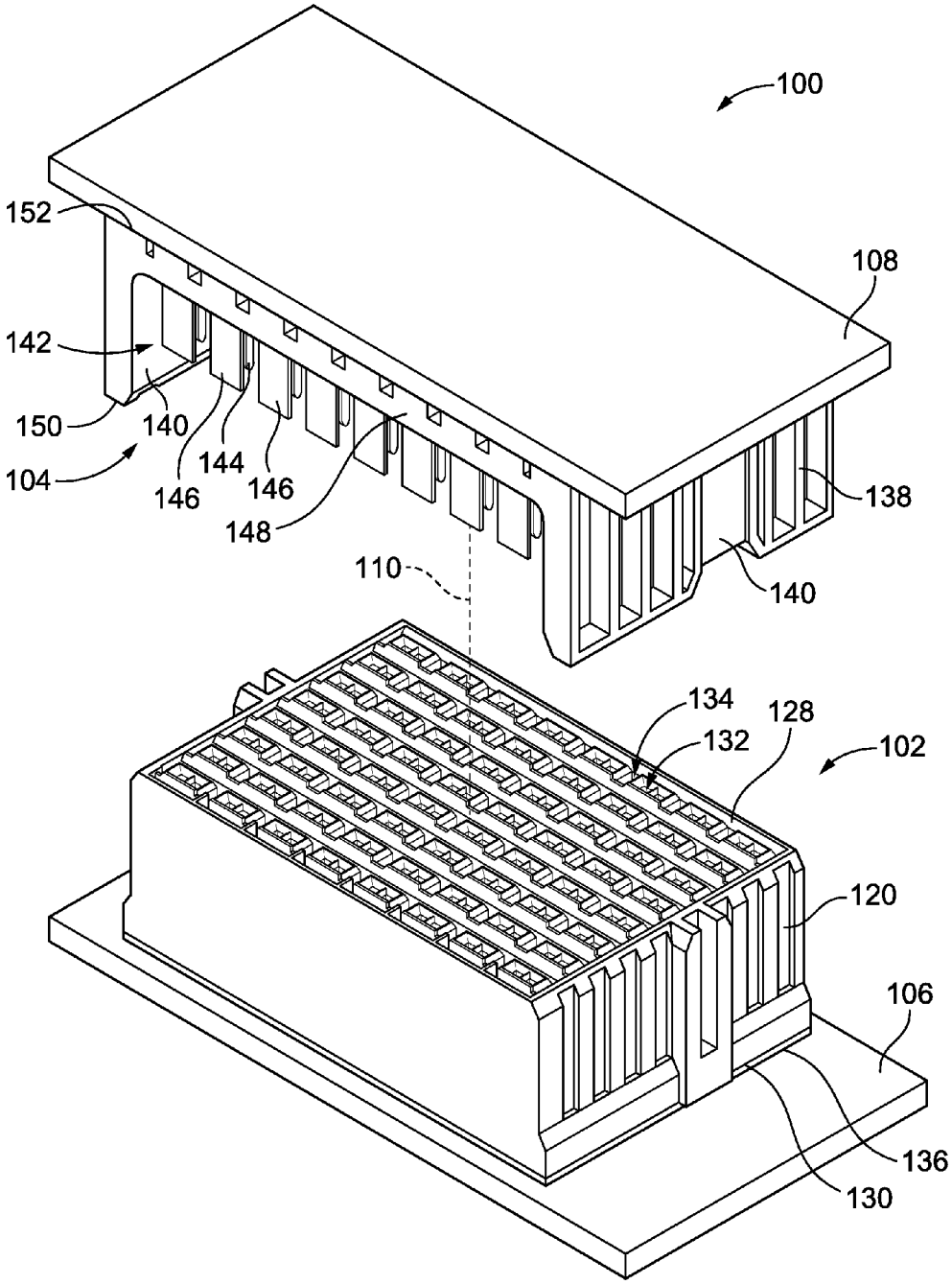
FIG. 1 is a perspective view of a modular connector assembly illustrating a header connector and a receptacle connector unmated and formed in accordance with an exemplary embodiment.

FIG. 1 is a perspective view of an exemplary embodiment of a modular connector assembly 100 illustrating a receptacle connector 102 and a header connector 104 that may be directly mated together. In an exemplary embodiment, the receptacle connector 102 and header connector 104 may be provided in a mezzanine arrangement between circuit boards. The modular connector assembly 100 may be referred to as a mezzanine connector assembly 100. The receptacle connector 102 and/or the header connector 104 may be referred to hereinafter individually as a "mezzanine connector" and may be referred to collectively as "mezzanine connectors". Other configurations are possible in alternative embodiments, including right angle connectors, cable mounted connectors, and the like.

The receptacle and header connectors 102, 104 are each electrically connected to respective receptacle and header circuit boards 106, 108. The receptacle and header connectors 102, 104 are utilized to electrically connect the circuit boards 106, 108 to one another at a separable mating interface. A mating axis 110 extends through the receptacle and header connectors 102, 104. The receptacle and header connectors 102, 104 are mated together in a direction parallel to and along the mating axis 110.

In an exemplary embodiment, the circuit boards 106, 108 are oriented parallel to one another and spaced apart from one another with the connectors 102, 104 therebetween. The circuit boards 106, 108 and connectors 102, 104 define a mezzanine arrangement where the circuit boards 106, 108 and connectors 102, 104 are stacked. The circuit boards 106, 108 may be oriented horizontally with the connectors 102, 104 defining vertical connectors between the horizontal circuit boards 106, 108. The signal contacts of the connectors 102, 104 pass in-line or linearly therethrough in a vertical direction. Alternative orientations of the circuit boards 106, 108 are possible in alternative embodiments.

Figure 2:
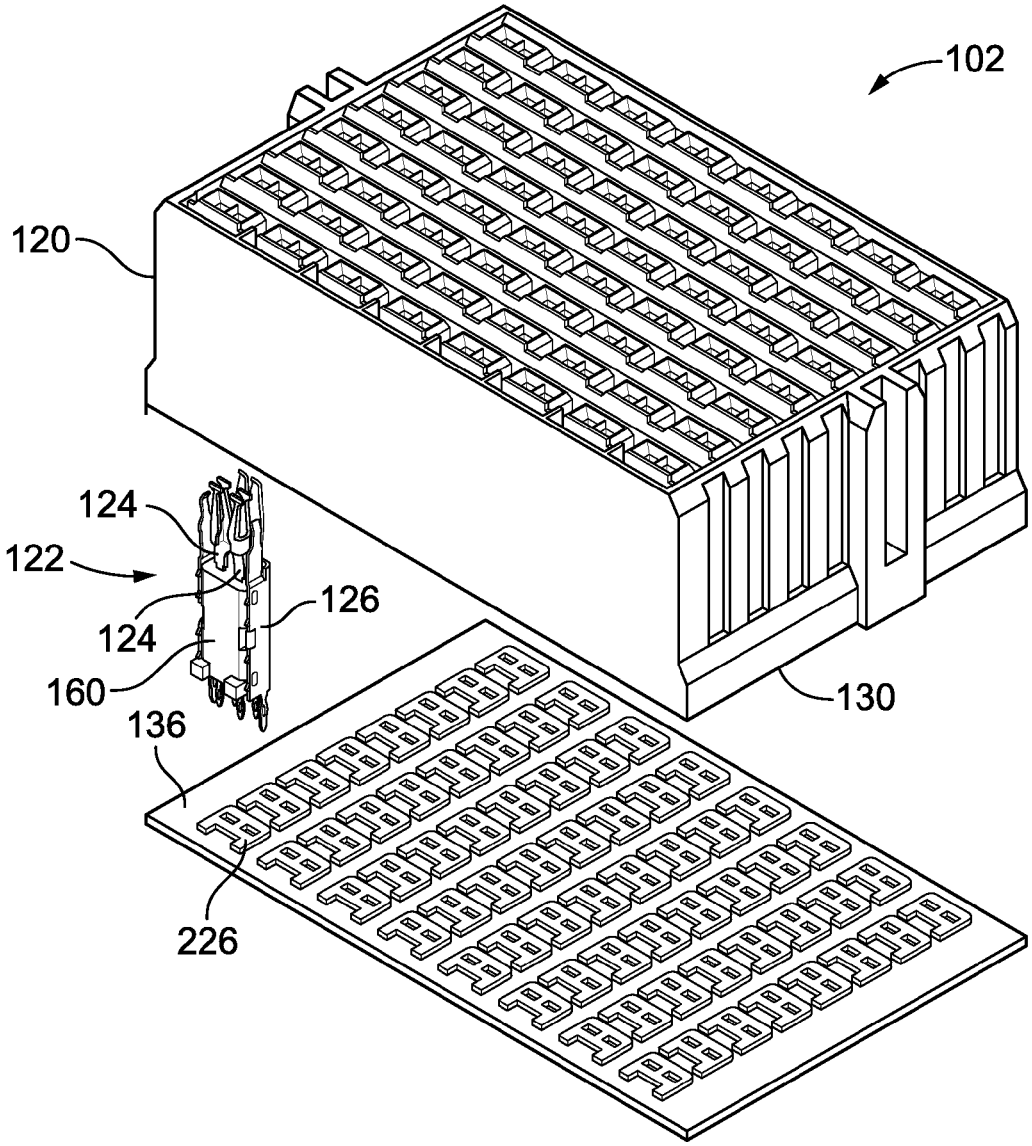
FIG. 2 is an exploded view of the receptacle connector showing a contact assembly poised for loading into a receptacle housing thereof.

The receptacle connector 102 includes a receptacle housing 120 that holds a plurality of contact assemblies 122 (shown in FIG. 2). Any number of contact assemblies 122 may be provided. The contact assemblies 122 each include receptacle signal contacts 124 (shown in FIG. 2) that are received in the receptacle housing 120 for mating with the header connector 104. Optionally, the receptacle signal contacts 124 may be electrically shielded.

The receptacle housing 120 includes a mating end 128 and a mounting end 130. In an exemplary embodiment, the mounting end 130 is substantially parallel to the mating end 128. The receptacle signal contacts 124 are received in the receptacle housing 120 and held therein for mating to the header connector 104. The receptacle signal contacts 124 are provided at the mounting end 130 for mounting to the receptacle circuit board 106. Optionally, the receptacle signal contacts 124 are arranged in a matrix of rows and columns.

The receptacle housing 120 includes a plurality of signal contact openings 132 and a plurality of ground contact openings 134 at the mating end 128. The receptacle signal contacts 124 are aligned with corresponding signal contact openings 132 for receiving corresponding header signal contacts 144 therein when the receptacle and header connectors 102, 104 are mated. The ground contact openings 134 receive header ground shields 146 therein when the receptacle and header connectors 102, 104 are mated.

The receptacle housing 120 is manufactured from a dielectric material, such as a plastic material, and provides isolation between the signal contact openings 132 and the ground contact openings 134. The receptacle housing 120 isolates the receptacle signal contacts 124 and the header signal contacts 144 from the header ground shields 146. The receptacle housing 120 isolates each set of receptacle and header signal contacts 124, 144 from other sets of receptacle and header signal contacts 124, 144. In an exemplary embodiment, an organizer 136 is mounted to the receptacle housing 120 between the mounting end 130 and the receptacle circuit board 106. The organizer 136 holds the positions of the receptacle signal contacts 124 for mounting to the circuit board 106.

The header connector 104 includes a header housing 138 having shroud walls 140 that extend along opposite sides of the header housing and define a cavity 142 therebetween. The header connector 104 has a mating end 150 and a mounting end 152 that is mounted to the header circuit board 108. Optionally, the mounting end 152 may be substantially parallel to the mating end 150. The receptacle connector 102 is received in the cavity 142 through the mating end 150. The receptacle housing 120 is positioned between, and may engage, the shroud walls 140 to guide the receptacle connector 102 in the cavity 142. The header signal contacts 144 and the header ground shields 146 extend from a base wall 148 into the cavity 142. The header signal contacts 144 and the header ground shields 146 extend through the base wall 148 and are mounted to the circuit board 108.

In an exemplary embodiment, the header signal contacts 144 are arranged as differential pairs. The header ground shields 146 are positioned between the differential pairs to provide electrical shielding between adjacent differential pairs. In the illustrated embodiment, the header ground shields 146 are C-shaped and provide shielding on three sides of the corresponding pair of header signal contacts 144. The header ground shield 146 associated with another pair of header signal contacts 144 provides the shielding along the open, fourth side of the adjacent header ground shield 146 such that each of the pairs of signal contacts 144 is shielded from each adjacent pair in the same column and the same row. Other configurations or shapes for the header ground shields 146 are possible in alternative embodiments. The shape of the header ground shields 146 may change along different portions thereof for impedance control or control of other electrical characteristics. Other embodiments may provide L-shaped shields that provide shielding on two sides, with adjacent header ground shields providing shielding along the open two sides of the header ground shields. More or less shield walls may be provided in alternative embodiments. The walls may be bent or angled rather than being planar. In other alternative embodiments, the header ground shields 146 may provide shielding for individual signal contacts 144 or sets of contacts having more than two signal contacts 144. The header ground shields 146 may be sized and shaped to provide certain electrical characteristics, such as to control the impedance of the signals.

FIG. 2 is an exploded view of the receptacle connector 102 showing one of the contact assemblies 122 poised for loading into the receptacle housing 120. The organizer 136 is shown poised for coupling to the mounting end 130 of the receptacle housing 120. The contact assembly 122 is configured to be loaded into the receptacle housing 120 through the mounting end 130 of the receptacle housing 120. The organizer 136 is coupled to the receptacle housing 120 and contact assemblies 122 after the contact assemblies 122 are loaded into the receptacle housing 120. The organizer 136 may be coupled to the mounting end 130 in stages, with the organizer initially partially coupled to the receptacle connector 102, such as for shipping to hold and protect the contacts, and then fully coupled to the receptacle connector 102 when mounted to the circuit board. The organizer may include pads 226 for a purpose which will be described below.

The contact assembly 122 includes a dielectric body 160 that holds corresponding receptacle signal contacts 124. In an exemplary embodiment, the dielectric body 160 holds a differential pair of receptacle signal contacts 124. The receptacle ground shield 126 is coupled to the dielectric body 160 and provides electrical shielding for the receptacle signal contacts 124. In an exemplary embodiment, each differential pair of receptacle signal contacts 124 is held by a separate dielectric body 160 having a separate receptacle ground shield 126. The differential pair of receptacle signal contacts 124 is electrically shielded from other differential pairs of receptacle signal contacts 124 of other contact assemblies 122 by the receptacle ground shield 126. The electrical shielding provided by the receptacle ground shield 126 reduces noise on each signal channel defined by the pair of receptacle signal contacts 124 improving the electrical characteristics of the signals transmitted by the signal channel. The receptacle connector 102 has higher performance as compared to receptacle connectors that do not provide individual shielding for pairs of receptacle signal contacts 124.

Figure 3:
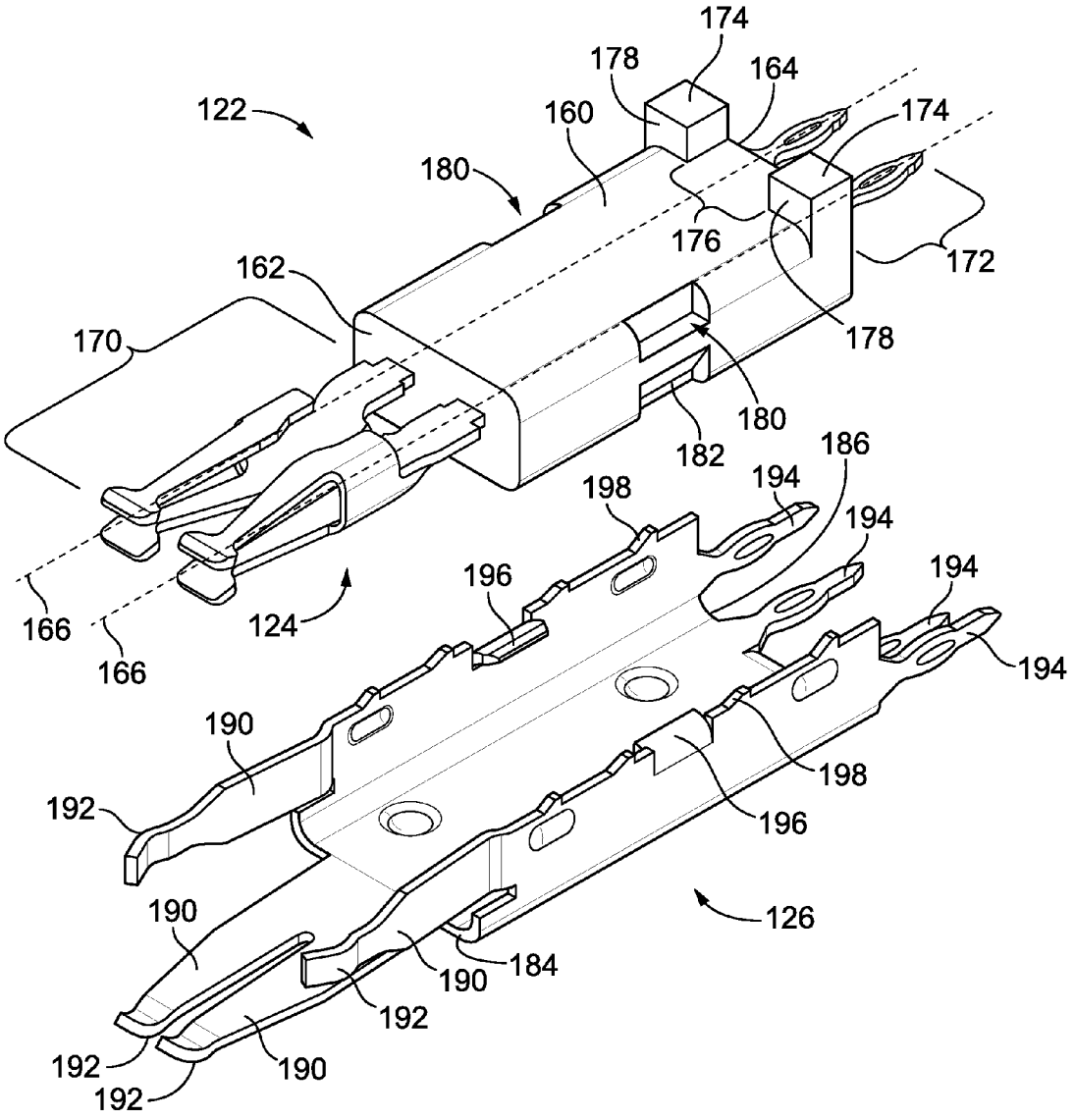
FIG. 3 is an exploded view of the contact assembly formed in accordance with an exemplary embodiment.

FIG. 3 is an exploded view of one of the contact assemblies 122 showing the receptacle ground shield 126 poised for coupling to the dielectric body 160. The dielectric body 160 at least partially surrounds the pair of receptacle signal contacts 124. Optionally, the dielectric body 160 may be overmolded around the signal contacts 124. Alternatively, the dielectric body 160 may be separately manufactured, such as molded, and then the signal contacts 124 may be loaded into the dielectric body 160, such as from an end or through a side thereof. The dielectric body 160 extends between a top 162 and a bottom 164. In an exemplary embodiment, the receptacle signal contacts 124 extend generally linearly through the dielectric body 160 between mating ends 170 and contact tails 172. For example, the receptacle signal contacts 124 extend along contact axes 166 through the dielectric body 160. Portions of the receptacle signal contacts 124 extend beyond the top 162 and beyond the bottom 164. For example, the receptacle signal contacts 124 have mating ends 170 that extend from the top 162 of the dielectric body 160 and contact tails 172 extending from the bottom 164 of the dielectric body 160. Rather than contact tails 172, the signal contacts 124 may be terminated to ends of wires, such as by crimping or soldering to the wires.

The mating ends 170 are configured to be mated with corresponding header signal contacts 144 (shown in FIG. 1). In an exemplary embodiment, the mating ends 170 define sockets configure to receive the header signal contacts 144. The sockets are defined by a pair of beams or paddles that resiliently engage the header signal contacts 144. The mating ends 170 may define other types of contacts in alternative embodiments, such as pins, blades, cylindrical barrels, spring beams or other types of contacts.

The contact tails 172 are configured to be terminated to the receptacle circuit board 106 (shown in FIG. 1). In the illustrated embodiment, the contact tails 172 are compliant pins, such as eye of the needle pins, which are configured to be through hole mounted to conductive vias of the receptacle circuit board 106. Other types of contact tails 172 may be used in alternative embodiments, such as beams configured to be surface mounted to the receptacle circuit board 106.

The dielectric body 160 includes legs 174 extending from one or more sides of the dielectric body 160. The legs 174 may be used to position the contact assembly 122 in the receptacle housing 120 (shown in FIG. 1). Optionally, the legs 174 may be provided at the bottom 164 of the dielectric body 160. A gap 176 is defined between the legs 174. The legs 174 have upward facing stop surfaces 178 that are used to position the contact assembly 122 in the receptacle housing 120.

The dielectric body 160 includes retention slots 180 along sides of the dielectric body 160. Portions of the receptacle ground shield 126 are received in the retention slots 180 to secure the receptacle ground shield 126 to the dielectric body 160. Optionally, the dielectric body 160 may include a ramp 182 that is used as a lead in to the retention slot 180. Other types of retaining features may be used in alternative embodiments.

The receptacle ground shield 126 extends between a top 184 and a bottom 186. In an exemplary embodiment, the receptacle ground shield 126 has a C-shape defined by a main wall and two shorter side walls; however the receptacle ground shield 126 may have other shapes in alternative embodiments. In an exemplary embodiment, the receptacle ground shield 126 has the same C-shape as the header ground shields 146 (shown in FIG. 1) such that the same shielding perimeter may surround the signal channels from the header circuit board 108 to the receptacle circuit board 106 (both shown in FIG. 1). For example, the receptacle signal contacts 124 may be spaced apart from the shield walls of the receptacle ground shield 126 by a distance that is approximately equal to the distance between the header signal contacts 144 and the header ground shields 146 (both shown in FIG. 1). Such spacing may provide impedance control along the signal channels between the receptacle and header circuit boards 106, 108. The spacing may not be equal, but may be selected to meet electrical requirements for signal integrity. The receptacle ground shield 126 is manufactured from a conductive material, such as a metal material, that provides electrical shielding for the receptacle signal contacts 124 around the dielectric body 160. In an exemplary embodiment, the receptacle ground shield 126 is stamped and formed, however the receptacle ground shield 126 may be manufactured using other processes and alternative embodiments.

The receptacle ground shield 126 includes grounding beams 190 extending upward from the top 184. In the illustrated embodiment, the receptacle ground shield 126 includes four grounding beams 190, with two grounding beams extending from the main wall and a single grounding beam 190 extending from each side wall of the receptacle ground shield 126. The receptacle ground shield 126 may include any number of grounding beams 190 in alternative embodiments. The grounding beams 190 are configured to extend along the mating ends 170 of the receptacle signal contacts 124. The grounding beams 190 are configured to resiliently engage corresponding header ground shields 146 (shown in FIG. 1) to electrically common the receptacle ground shield 126 with the corresponding header ground shield 146. For example, in an exemplary embodiment, each grounding beam 190 includes a contact bump 192 that is configured to engage the corresponding header ground shield 146.

In an exemplary embodiment, the receptacle ground shield 126 includes ground tails 194 extending from the bottom 186. The ground tails 194 extend along the contact tails 172. The ground tails 194 are configured to be terminated to the receptacle circuit board 106. In the illustrated embodiment, the ground tails 194 are compliant pins, such as eye of the needle pins, which are configured to be through hole mounted to conductive vias of the receptacle circuit board 106 to electrically connect to a ground plane of the receptacle circuit board 106. Other types of ground tails 194 may be provided in alternative embodiments, such as beams for surface mounting to the receptacle circuit board 106.

In an exemplary embodiment, the receptacle ground shield 126 includes retention tabs 196 along both sides of the receptacle ground shield 126. The retention tabs 196 are configured to be received in corresponding retention slots 180 in the dielectric body 160 to secure the receptacle ground shield 126 to the dielectric body 160.

In an exemplary embodiment, the receptacle ground shield 126 includes retention barbs 198 extending from both sides thereof. The retention barbs 198 are configured to engage the receptacle housing 120 to secure the contact assembly 122 in the receptacle housing 120. For example, the retention barbs 198 may dig into the plastic material of the receptacle housing 120 to hold the contact assembly 122 in receptacle housing 120.

Figure 4:
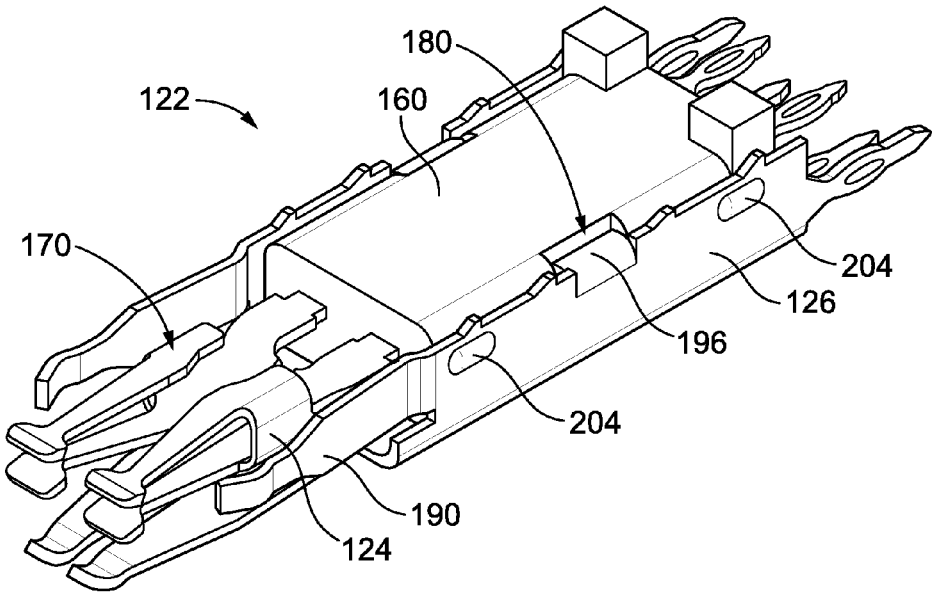
FIGS. 4 and 5 are side perspective views of the contact assembly.
Figure 5:
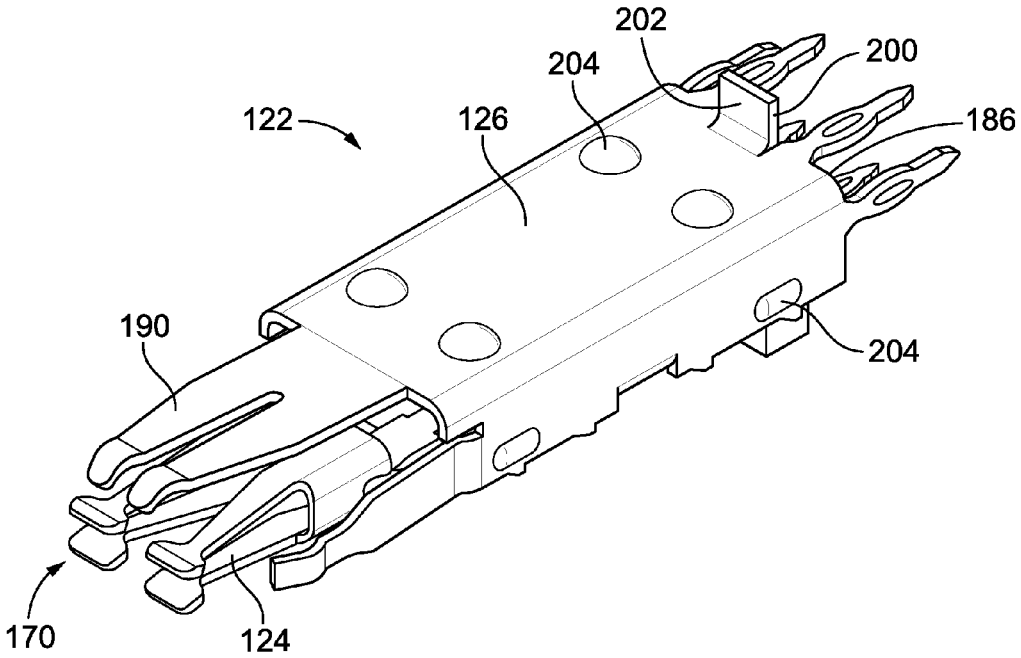

FIGS. 4 and 5 are side perspective views of the contact assembly 122 formed in accordance with an exemplary embodiment showing the receptacle ground shield 126 coupled to the dielectric body 160. The retention tabs 196 are received in the retention slots 180 to secure the receptacle ground shield 126 to the dielectric body 160. The interior surface of the receptacle ground shield 126 may directly engages the exterior surface of the dielectric body 160. Alternatively, clearance may be provided between the receptacle ground shield 126 and portions of the dielectric body 160. The grounding beams 190 extend along and provide shielding for the mating ends 170 of the receptacle signal contacts 124.

In an exemplary embodiment, as shown in FIG. 5, the receptacle ground shield 126 includes a stop tab 200 extending therefrom. Optionally, the stop tab 200 may be provided at the bottom 186 of the receptacle ground shield 126. The stop tab 200 includes an upward facing surface 202 that is configured to engage the receptacle housing 120 (shown in FIG. 3) to position the contact assembly 122 with respect to the receptacle housing 120.

The receptacle ground shield 126 includes a plurality of locating features 204 used to locate and/or retain the contact assembly 122 within the receptacle housing 120. In the illustrated embodiment, the locating features 204 are bumps or protrusions that may be formed in one or more of the side walls of the receptacle ground shield 126. The locating features 204 may engage the receptacle housing 120 to hold the contact assembly 122 in the receptacle housing 120 by an interference fit.

Figure 6:
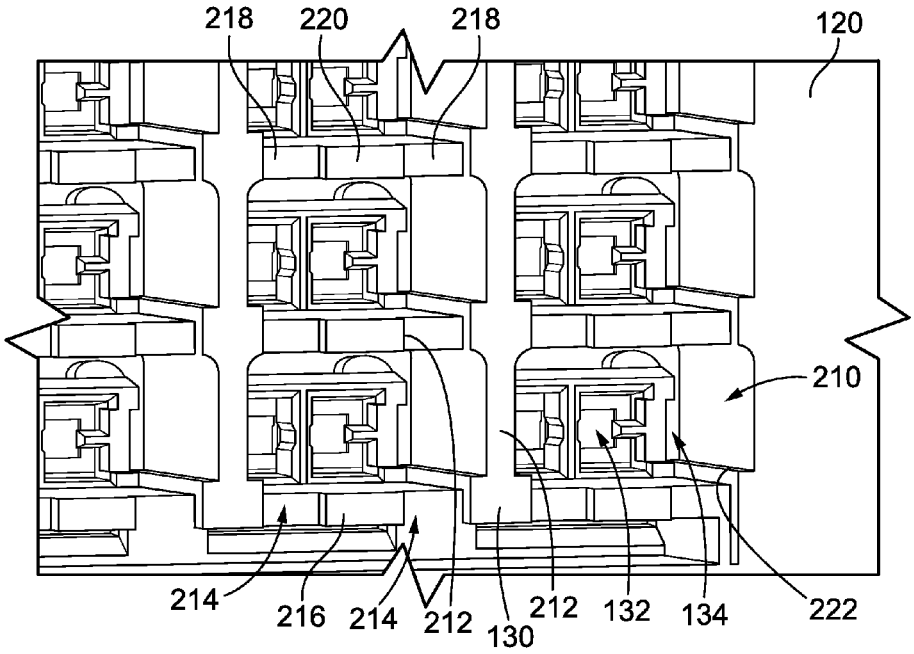
FIG. 6 is a bottom perspective view of a portion of the receptacle housing.

FIG. 6 is a bottom perspective view of a portion of the receptacle housing 120. The receptacle housing 120 includes a plurality of chambers 210 sized and shaped to receive corresponding contact assemblies 122 (shown in FIG. 2). In an exemplary embodiment, each chamber 210 receives a single contact assembly 122. Each chamber 210 houses a single differential pair of receptacle signal contacts 124 (shown in FIG. 2). The signal and ground contact openings 132, 134 are shown in FIG. 6. The signal and ground contact openings 132, 134 are open to the corresponding chambers 210.

The receptacle housing 120 includes chamber walls 212 that separate each of the chambers 210. The chambers 210 have a complementary shape to the contact assemblies 122 configured to be received therein. Optionally, the chamber walls 212 may be oriented approximately perpendicular to one another to define generally rectangular shaped chambers 210; however the chambers 210 may have any shape in alternative embodiments.

In an exemplary embodiment, the receptacle housing 120 includes one or more pockets 214 in the chamber walls 212 at the bottom or mounting end 130 of the receptacle housing 120. Posts 216 are defined between the pockets 214. The pockets 214 and posts 216 have downward facing abutment surfaces 218, 220, respectively. The contact assemblies 122 are configured to be loaded into the chambers 210 until the contact assemblies 122 engage the abutment surfaces 218, 220. Optionally, the abutment surfaces 218, 220 define travel limits and the contact assemblies 122 may stop short of engaging the abutment surfaces 218, 220.

The receptacle housing 120 may include shoulders 222 extending along the chamber walls 212 within the chamber 210. Portions of the contact assemblies 122 may engage the shoulders 222 to locate and/or secure the contact assemblies 122 within the chambers 210.

Figure 7:
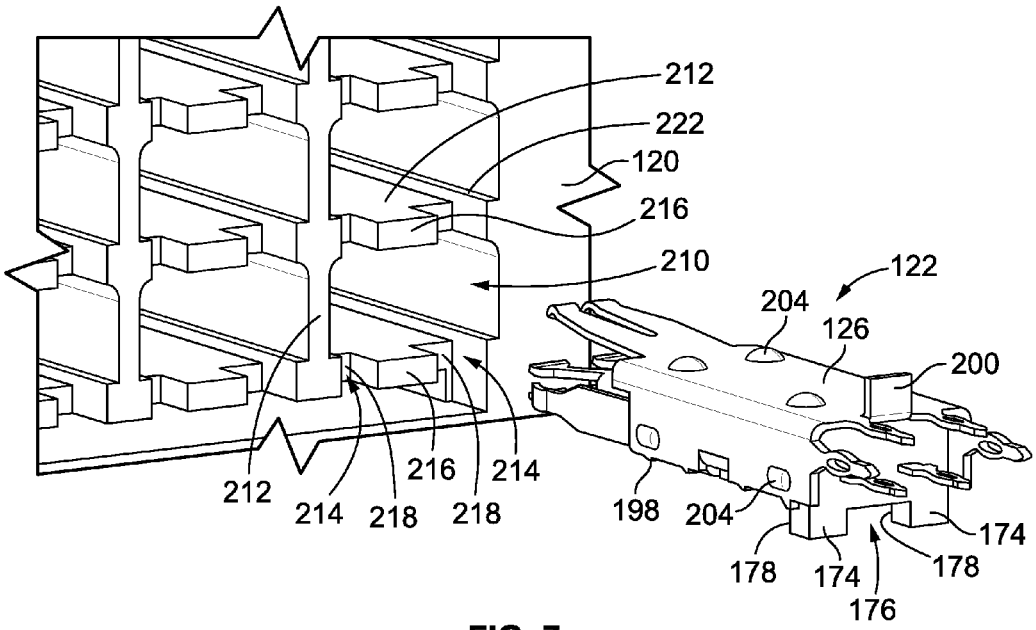
FIG. 7 is a bottom perspective view of a portion of the receptacle housing showing one of the contact assemblies poised for loading into the corresponding chamber.

FIG. 7 is a bottom perspective view of a portion of the receptacle housing 120 showing one of the contact assemblies 122 poised for loading into the corresponding chamber 210. The contact assembly 122 is loaded into the chamber 210 until the stop tab 200 engages the corresponding post 216. The legs 174 are received in corresponding pockets 214 such that the corresponding post 216 is located within the gap 176. The contact assembly 122 is loaded into the chamber 210 until the stop surfaces 178 of the legs 174 engage the abutment surfaces 218. Other stop or travel limit features may be used in alternative embodiments.

The retention barbs 198 along the sides of the receptacle ground shield 126 are configured to engage the shoulders 222. The retention barbs 198 may dig into the shoulders 222 to secure the contact assembly 122 within the chamber 210 and prevent the contact assembly 122 from backing out of the chamber 210. Other types of features may be used in other embodiments to secure the contact assembly 122 in the chamber 210, such as latches, interference features, fasteners, and the like. The locating features 204 may engage portions of the chamber walls 212 to locate the contact assembly 122 within the chamber 210.

Figure 8:
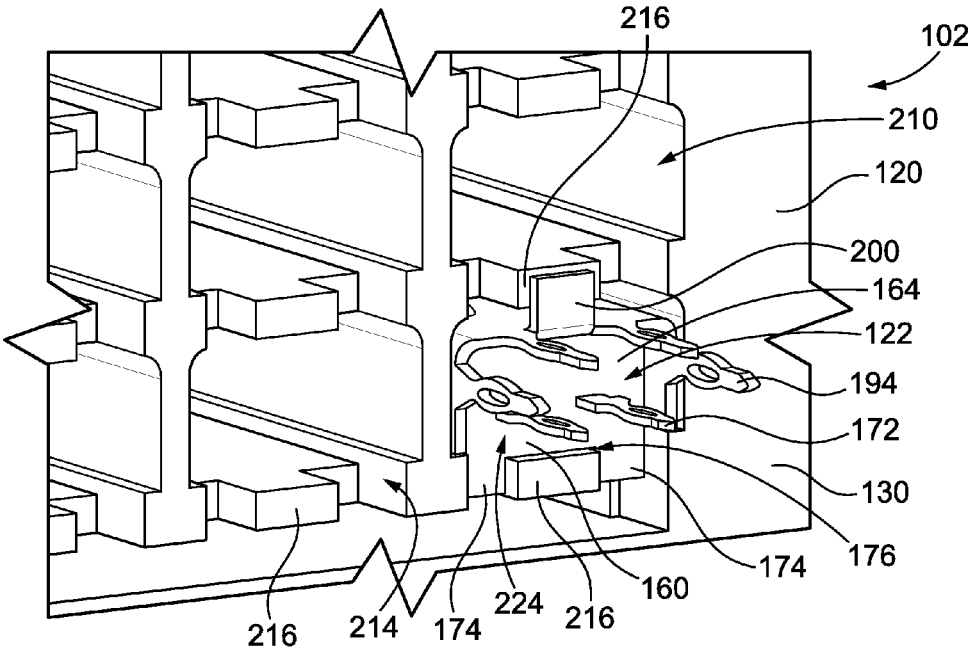
FIG. 8 illustrates a portion of the receptacle housing showing one of the contact assemblies loaded into the corresponding chamber.

FIG. 8 illustrates a portion of the receptacle housing 120 showing one of the contact assemblies 122 loaded into the corresponding chamber 210. The stop tab 200 is shown abutting against the corresponding post 216. The legs 174 are shown in the pockets 214 with the post 216 received in the gap 176. The contact tails 172 and ground tails 194 extend downward beyond the bottom or mounting end 130 of the receptacle housing 122 for terminating to the receptacle circuit board 106 (shown in FIG. 1).

In an exemplary embodiment, the receptacle ground shield 126 extends rearward beyond the bottom 164 of the dielectric body 160 thus defining a pocket 224 at the bottom 164 of the dielectric body 160. The pocket 224 is surrounded by the portion of the receptacle ground shield 126 that extends beyond the dielectric body 160. In an exemplary embodiment, a portion of the organizer 136 (shown in FIG. 2) substantially fills the pocket 224 when fully seated on the circuit board. For example, the organizer 136 may include pads 226 (shown in FIG. 2) having a similar size and shape as the pockets 224. The pads 226 are manufactured from a material having a dielectric constant that may be the same as or similar to a dielectric constant of the material of the dielectric body 160, such as to meet signal integrity or electrical requirements. As such, the signal path defined along the receptacle signal contacts 124 may be surrounded by dielectric material having a generally constant dielectric constant along the length of the signal paths between the receptacle circuit board 106 and the header connector 104 (both shown in FIG. 1).

Each of the chambers 210 is configured to receive the same type of contact assembly 122. The receptacle connector 102 may have any number of receptacle signal contacts 124 by simply providing a receptacle housing 120 have an appropriate number of chambers 210. The modular design of the contact assemblies 122 provide for ease of manufacture of receptacle connectors 102. For example, one version of the receptacle connector 102 may include a 4×4 arrangement having four contact assemblies 122 in each row and four columns of contact assemblies 122. Another receptacle connector 102 may provide an 8×8 arrangement while another receptacle connector 102 may provide a 3×6 arrangement. Other arrangements are possible in alternative embodiments. The same contact assemblies 122 may be provided in any of the receptacle connectors 102, the only change being the receptacle housing 120 having a different number of chambers 210.

Figure 9:
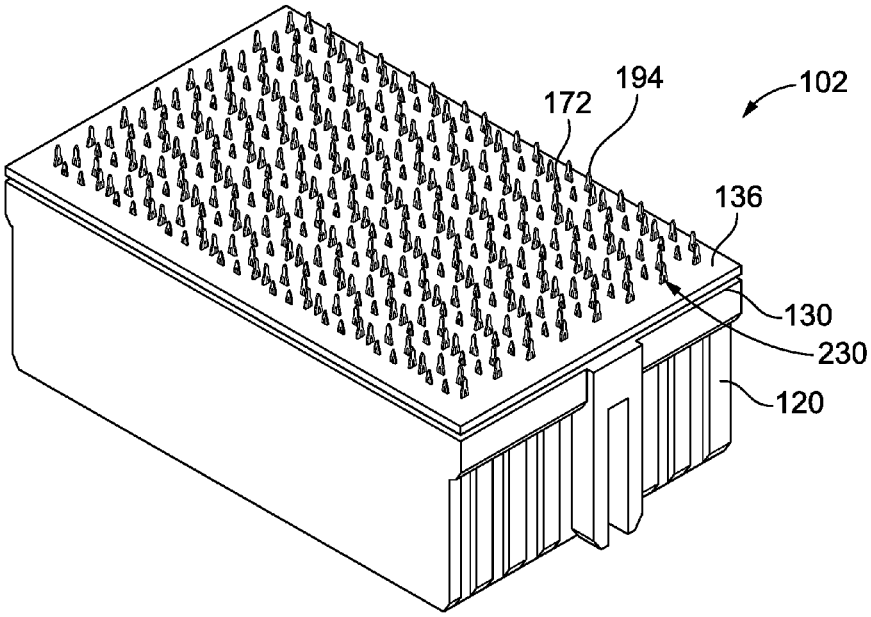
FIG. 9 is a bottom perspective view of the receptacle connector showing an organizer coupled to a mounting end of the receptacle housing.

FIG. 9 is a bottom perspective view of the receptacle connector 102 showing the organizer 136 coupled to the mounting end 130 of the receptacle housing 120. The contact tails 172 and ground tails 194 are shown extending through corresponding openings 230 in the organizer 136. The organizer 136 holds the spacing of the contact tails 172 and ground tails 194 relative to one another. Optionally, the ground tails 194 may be longer than the contact tails 172 such that the ground tails 194 are loaded into the corresponding vias in the receptacle circuit board 106 (shown in FIG. 1) prior to the contact tails 172 being loaded into the corresponding vias in the receptacle circuit board 106. The ground tails 194 may thus be used to locate the receptacle connector 102 relative to the receptacle circuit board 106 prior to the contact tails 172 being loaded into the vias in the receptacle circuit board 106. Damage to the contact tails 172 is avoided by such an arrangement.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A modular connector assembly comprising:

a housing having a mating end and a mounting end opposite the mating end, the mating end being configured to be mated with a header connector, the mounting end being configured to be mounted to a circuit board, the housing having a plurality of individual chambers separated by chamber walls;

contact assemblies received in corresponding chambers, each contact assembly having a dielectric body holding a differential pair of receptacle signal contacts, the receptacle signal contacts being configured to be terminated to the circuit board, the receptacle signal contacts being configured to be mated with corresponding header signal contacts of the header connector, each contact assembly having a ground shield coupled to an exterior of the dielectric body, the ground shield providing electrical shielding for the differential pair of receptacle signal contacts from other pairs of receptacle signal contacts.

2. The modular connector assembly of claim 1, wherein the ground shield is C-shaped and surrounds the differential pair of receptacle signal contacts on three sides thereof.

3. The modular connector assembly of claim 1, wherein each ground shield cooperates with adjacent ground shields to provide electrical shielding of each differential pair of receptacle signal contacts from each other differential pair of receptacle signal contacts.

4. The modular connector assembly of claim 1, wherein the dielectric body is overmolded around the corresponding differential pair of receptacle signal contacts, the overmolded dielectric body and the corresponding differential pair of receptacle signal contacts being loaded into the corresponding chamber and separated from other contact assemblies by the chamber walls.

5. The modular connector assembly of claim 1, wherein the receptacle signal contacts extend along contact axes through the dielectric body, the contact axes being perpendicular to the circuit board.

6. The modular connector assembly of claim 1, wherein the receptacle signal contacts extend along contact axes through the dielectric body, the contact axes being perpendicular to the mating end and the mounting end.

7. The modular connector assembly of claim 1, wherein the receptacle signal contacts include tails extending from the mating end, the tails being terminated to the circuit board.

8. The modular connector assembly of claim 1, wherein the receptacle signal contacts include mating ends extended from a top of the dielectric body, the mating end of each receptacle signal contact defining a socket configured to be mated with a corresponding header signal contact of the header connector.

9. The modular connector assembly of claim 8, wherein the ground shield includes grounding beams extending from a top of the ground shield, the grounding beams extending along the mating ends of the receptacle signal contacts, the grounding beams being coupled to the corresponding header ground shield of the header connector.

10. The modular connector assembly of claim 1, wherein the ground shield includes retention barbs, the retention barbs engaging the chamber walls to hold the contact assemblies in the corresponding chambers.

11. The modular connector assembly of claim 1, wherein the ground shield includes a stop tab at a bottom of the ground shield, the contact assembly being loaded into the chamber until the stop tab engages the housing.

12. The modular connector assembly of claim 1, wherein the ground shield includes locating features engaging the chamber walls, the locating features locating the contact assembly within the chamber.

13. The modular connector assembly of claim 1, wherein the dielectric body includes legs at the bottom of the dielectric body, the legs engaging the housing to locate the contact assembly within the chamber.

14. The modular connector assembly of claim 1, wherein the dielectric body includes retention slots along sides thereof, the ground shield including retention tabs extending therefrom, the retention tabs being received in the retention slots to secure the ground shield to the dielectric body.

15. The modular connector assembly of claim 1, wherein a bottom of the ground shield extends downward beyond a bottom of the dielectric body defining a pocket at the bottom of the dielectric body, the ground shield comprising ground tails extending from the bottom of the ground shield, the receptacle signal contacts having contact tails extending downward from the bottom of the dielectric body, the ground tails and the contact tails being terminated to the circuit board, the modular connector assembly further comprising an organizer coupled to the mounting end of the housing, the organizer having a plurality of channels therethrough receiving corresponding ground tails and contact tails to position the ground tails and the contact tails relative to one another, the organizer having pads substantially filling each pocket.

16. A modular connector assembly comprising:

a header connector comprising a header housing having a base wall and shroud walls extending from the base wall and defining a cavity, the base wall being configured to be mounted to a header circuit board, the header housing holding a plurality of header signal contacts in the cavity, the header signal contacts being arranged in pairs, the header housing holding a plurality of header ground shields in the cavity, each header ground shield at least partially surrounding a corresponding pair of header signal contacts;

a receptacle connector received in the cavity and coupled to the header connector, the receptacle connector comprising a receptacle housing having a mating end and a mounting end opposite the mating end, the mating end being configured to be mated with the header connector, the mounting end being configured to be mounted to a receptacle circuit board, the receptacle housing having a plurality of individual chambers separated by chamber walls, the receptacle connector comprising contact assemblies received in corresponding chambers, each contact assembly having a dielectric body holding a differential pair of receptacle signal contacts, the receptacle signal contacts being configured to be terminated to the receptacle circuit board, the receptacle signal contacts being configured to be mated with corresponding header signal contacts of the header connector, each contact assembly having a receptacle ground shield coupled to an exterior of the dielectric body, the receptacle ground shield providing electrical shielding for the differential pair of receptacle signal contacts from other pairs of receptacle signal contacts, each receptacle ground shield being mated with a corresponding header ground shield.

17. The modular connector assembly of claim 16, wherein the receptacle ground shield is C-shaped and surrounds the differential pair of receptacle signal contacts on three sides thereof.

18. The modular connector assembly of claim 16, wherein the dielectric body is overmolded around the corresponding differential pair of receptacle signal contacts, the overmolded dielectric body and differential pair of receptacle signal contacts being loaded into the corresponding chamber and separated from other contact assemblies by the chamber walls.

19. The modular connector assembly of claim 16, wherein the receptacle signal contacts extend along contact axes through the dielectric body, the contact axes being perpendicular to the mating end and the mounting end.

20. The modular connector assembly of claim 16, wherein the ground shield includes a stop tab at a bottom of the ground shield, the contact assembly being loaded into the chamber until the stop tab engages the housing.

* * * * *